US010480103B2

(12) United States Patent
Minehardt

(10) Patent No.: US 10,480,103 B2
(45) Date of Patent: Nov. 19, 2019

(54) SELF-WARMING INSULATION

(71) Applicant: PRIMALOFT, INC., Latham, NY (US)

(72) Inventor: Jon-Alan Minehardt, Clifton Park, NY (US)

(73) Assignee: PRIMALOFT, INC., Latham, NY (US)

( * ) Notice: Subject to any disclaimer, the term of this patent is extended or adjusted under 35 U.S.C. 154(b) by 233 days.

(21) Appl. No.: 15/572,086

(22) PCT Filed: May 19, 2016

(86) PCT No.: PCT/US2016/033280

§ 371 (c)(1),
(2) Date: Nov. 6, 2017

(87) PCT Pub. No.: WO2016/191203

PCT Pub. Date: Dec. 1, 2016

(65) Prior Publication Data

US 2018/0142383 A1 May 24, 2018

Related U.S. Application Data

(60) Provisional application No. 62/165,520, filed on May 22, 2015.

(51) Int. Cl.
*D02G 3/02* (2006.01)
*D04H 1/02* (2006.01)
(Continued)

(52) U.S. Cl.
CPC ..... *D02G 3/02* (2013.01); *D04H 1/02* (2013.01); *D04H 1/435* (2013.01); *D04H 1/4382* (2013.01)

(58) Field of Classification Search
CPC ..... D02G 3/02; D02G 3/025; D02G 3/04; D02G 3/042–047; D04H 1/00–76; D04H 1/435; D04H 1/4358–4391
See application file for complete search history.

(56) References Cited

U.S. PATENT DOCUMENTS 3,454,422 A 7/1969 Mead et al.
4,281,042 A 7/1981 Pamm
(Continued)

FOREIGN PATENT DOCUMENTS

CN 203446589 U 2/2014
EP 1118698 A2 7/2001
(Continued)

OTHER PUBLICATIONS

International Search Report and Written Opinion of the International Searching Authority for PCT/US2016/033280 dated Aug. 30, 2016.

*Primary Examiner* — Ismael Izaguirre
(74) *Attorney, Agent, or Firm* — Heslin Rothenberg Farley & Mesiti P.C.

(57) ABSTRACT

The invention provides an insulation material that includes exothermic fibers, heat capturing fibers capable of retaining heat, and synthetic fibers. The heat capturing fibers having a density of at least 1.17 g/cm$^3$ or 2.0 Dtex linear density. Also provided are articles comprising, and methods of making the inventive insulation material.

20 Claims, 5 Drawing Sheets

(51) Int. Cl.
*D04H 1/435* (2012.01)
*D04H 1/4382* (2012.01)

(56) References Cited

U.S. PATENT DOCUMENTS 4,304,817 A 12/1981 Frankosky
4,794,038 A 12/1988 Marcus
5,766,745 A 6/1998 Smith et al.
5,798,166 A 8/1998 Gross
6,046,119 A 4/2000 Kaibe et al.
6,264,681 B1 * 7/2001 Usui ..... A43B 1/0054 607/108
6,329,051 B1 12/2001 Groh et al.
6,329,052 B1 12/2001 Groh et al.
6,492,020 B1 12/2002 Ahn et al.
6,589,652 B2 7/2003 Groh et al.
6,802,081 B1 10/2004 Ogino et al.
7,261,936 B2 8/2007 Davis et al.
7,790,639 B2 9/2010 Davenport et al.
8,673,448 B2 3/2014 Hartmann et al.
9,185,941 B2 11/2015 Mason et al.
9,340,907 B2 5/2016 Patterson
2003/0068949 A1 4/2003 Ishii et al.
2004/0198125 A1 * 10/2004 Mater ..... A47C 31/001 442/394
2008/0066347 A1 3/2008 Suzuki
2010/0015430 A1 1/2010 Hartmann et al.
2014/0206796 A1 7/2014 Allampalayam Jayaraman et al.
2014/0273701 A1 * 9/2014 Samanta ..... E04B 1/78 442/334

FOREIGN PATENT DOCUMENTS

JP H11299616 A 11/1999
JP 2001112578 A 4/2001
JP 2001288656 A 10/2001
JP 2002084952 A 3/2002
JP 2003227043 A * 8/2003
JP 2004300584 A * 10/2004
JP 2005017243 A1 * 2/2005
WO 91/14029 A1 9/1991
WO 00/06379 A1 2/2000
WO 2008/030648 A1 3/2008
WO 2016/100616 A1 6/2016
WO 2016/118614 A1 7/2016
WO 2016/191202 A1 12/2016

* cited by examiner

SELF-WARMING INSULATION

CROSS REFERENCE TO RELATED APPLICATIONS

This application is a U.S. national phase entry under Section 371 of International Application No. PCT/US2016/033280, filed on May 19, 2016, which published as WO 2016/191203 A1 on Dec. 1, 2016, which claims priority to U.S. Provisional Application No. 62/165,520, filed on May 22, 2015. The entire contents of each of the prior applications are hereby incorporated herein by reference.

FIELD OF THE INVENTION

The present invention generally relates to insulation material, and to articles comprising and methods of forming the same.

BACKGROUND OF THE INVENTION

It is desirable for insulative articles, such as clothing, bedding, sleeping bags, etc., to be able to retain heat. Traditionally, this goal has been effectuated through the use of feathers (down) in insulation materials. U.S. Pat. No. 6,802,081 teaches of the difficulties in the art relating to the blending of moisture-absorbent/releasable heat-generating fiber with a fiber of another species at a stable blending ratio. U.S. Pat. No. 6,802,081 discloses insulation that includes fibers (e.g., feathers) having a specified air layer of not less than 50 ml per gram. The immobile air layer is imperative, as it serves to retain heat in the insulation.

Notwithstanding previous efforts, a need remains for novel insulation materials that are capable of generating and retaining heat.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

Briefly, the present invention satisfies the need for insulation material that is capable of generating and retaining heat. The present invention may address one or more of the problems and deficiencies of the art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

Certain embodiments of the presently-disclosed insulation material, articles comprising the insulation material, and methods for forming the insulation material have several features, no single one of which is solely responsible for their desirable attributes. Without limiting the scope of the insulation, articles, and methods as defined by the claims that follow, their more prominent features will now be discussed briefly. After considering this discussion, and particularly after reading the section of this specification entitled "Detailed Description of the Invention," one will understand how the features of the various embodiments disclosed herein provide a number of advantages over the current state of the art.

In one aspect, the invention provides an insulation material comprising:

exothermic fibers;

heat capturing fibers capable of retaining heat, said heat capturing fibers having a density of at least 1.17 g/cm$^3$ or 2.0 Dtex linear density; and synthetic fibers.

In a second aspect, the invention provides an article comprising the insulation material of the first aspect of the invention.

In a third aspect, the invention provides a method of forming the insulation material of the first aspect of the invention.

These and other features and advantages of this invention will become apparent from the following detailed description of the various aspects of the invention taken in conjunction with the appended claims and the accompanying drawings.

BRIEF DESCRIPTION OF THE DRAWINGS

The present invention will hereinafter be described in conjunction with the following drawing figures, wherein.

DETAILED DESCRIPTION OF THE INVENTION

Aspects of the present invention and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the invention in detail. It should be understood, however, that the detailed description and the specific example(s), while indicating embodiments of the invention, are given by way of illustration only, and are not by way of limitation. Various substitutions, modifications, additions and/or arrangements within the spirit and/or scope of the underlying inventive concepts will be apparent to those skilled in the art from this disclosure.

In one aspect, the invention provides an insulation material comprising:

exothermic fibers;

heat capturing fibers capable of retaining heat, said heat capturing fibers having a density of at least 1.17 g/cm$^3$ or 2.0 Dtex linear density; and synthetic fibers.

Figure 1A:
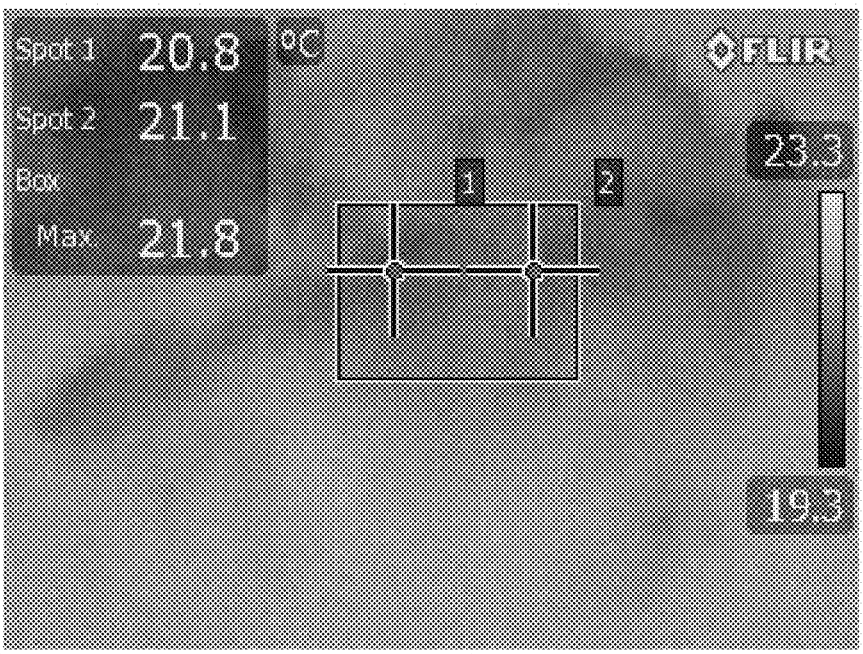
FIGS. 1A and 1B are FLIR thermal heat images of non-hygroscopic exothermic fibers before and after being held in hand for one minute, respectively.
Figure 1B:
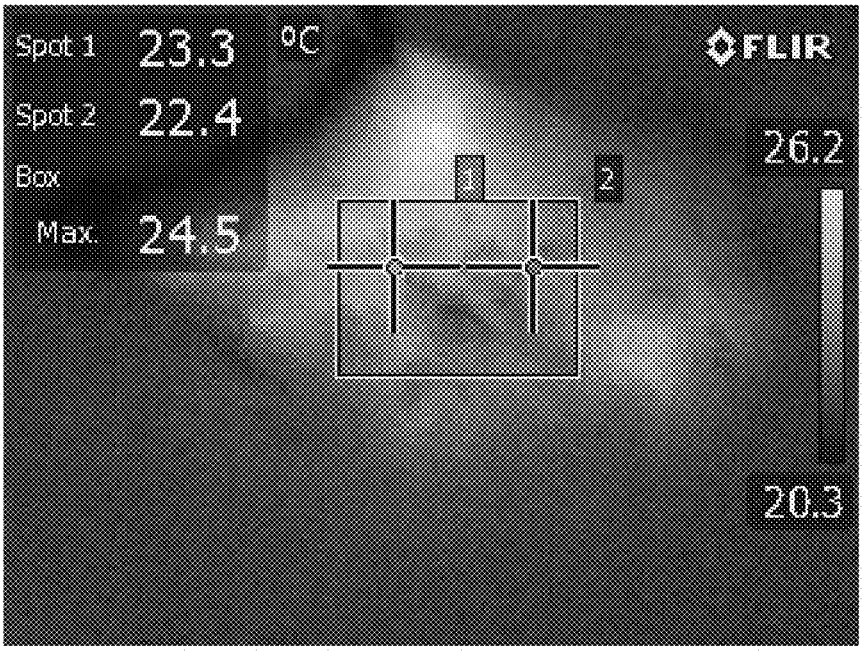
Figure 2A:
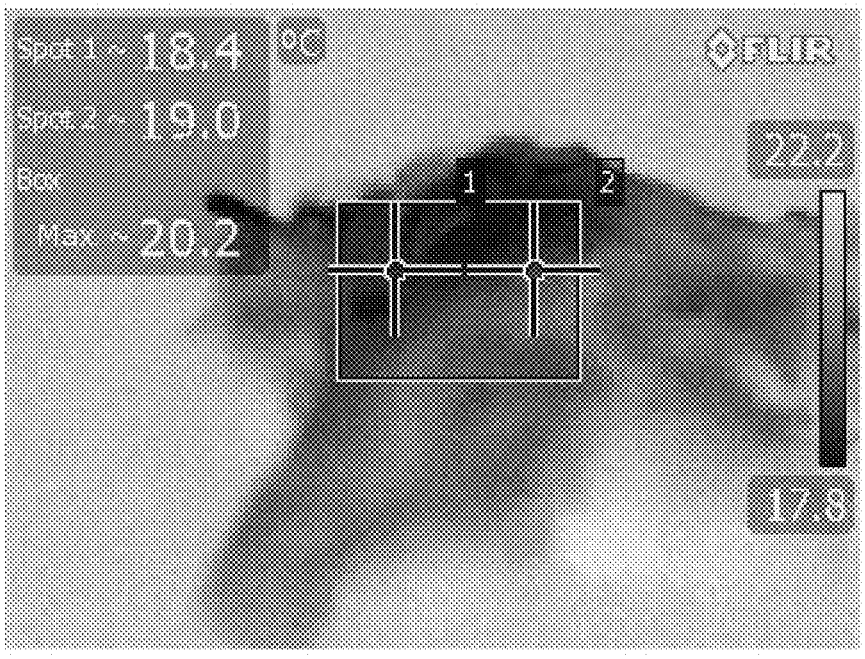
FIGS. 2A and 2B are FLIR thermal heat images of hygroscopic exothermic fibers before and after being held in hand for one minute, respectively.
Figure 2B:
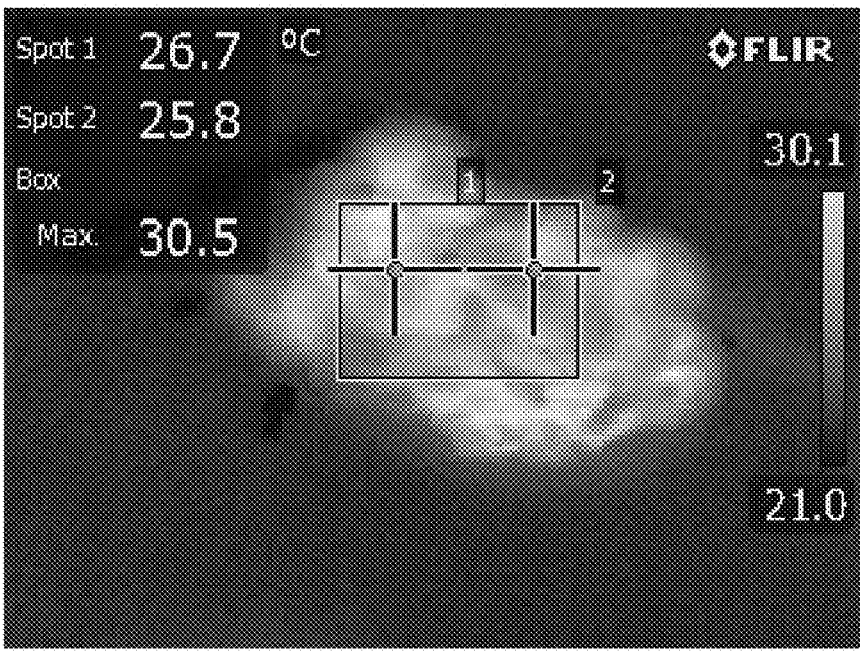

The exothermic fibers are capable of generating heat. For example, in some embodiments, the exothermic fibers absorb a certain spectrum of light (e.g., infrared) and generate heat. In other embodiments, the exothermic fibers are hygroscopic exothermic fibers that are capable of generating heat upon absorption of moisture. This is illustrated, for example, in FIGS. 2A and 2B, which are FLIR thermal heat images of SUNBURNER hygroscopic exothermic fibers before and after being held in hand for one minute, respectively. As can be seen, the fibers, via absorbing moisture from the hand, generate heat. FIGS. 1A and 1B, on the other hand, are FLIR thermal heat images of 100% polyester non-hygroscopic non-exothermic fibers before and after being held in hand for one minute, respectively.

A non-limiting example of the exothermic fibers is heat-generative acrylic fibers (e.g., COREBRID fibers, available from Mitsubishi Rayon Co., Ltd. http://www.nedtex.nl/files/NineSigma_REQ_69501.pdf).

Non-limiting examples of hygroscopic exothermic fibers capable of generating heat upon absorption of moisture include rayon, wool (e.g., sheep wool), fibers containing activated carbon, and acrylate-based hygroscopic and exothermic fibers (e.g., EKS fiber available from Toyobo Co., Ltd., SUNBURNER fibers available from Toho Textiles, etc.). As described in U.S. 2008-0066347 and JP-A-2001-112578, such acrylate based hygroscopic and exothermic fiber may be a fiber in which a fiber formed of an acrylonitrile based polymer containing 40% by weight or more of acrylonitrile is used as a starting material and a hydrazine based compound is introduced as a crosslinking agent.

In some embodiments, the hygroscopic exothermic fibers have a moisture absorption rate of at least 12%. As used herein, the moisture absorption rate (%) is determined by drying a 5.0 gram fiber sample for 16 hours in a hot air dryer at 105° C., after which the sample mass (a) is determined. Then, the sample is placed in a thermo-hygrostat at a temperature of 20° C. and a relative humidity (RH) of 65% for 24 hours. After the 24 hour absorbency period, the mass of the sample (b) is determined. Rate of moisture absorption is calculated using the formula $(a-b)/a\times100\%$. In some embodiments, the hygroscopic exothermic fibers have a moisture absorption rate of at least 16%. In some embodiments, the hygroscopic exothermic fibers have a moisture absorption rate of 12-50% (e.g., 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50%), including any and all ranges and subranges therein (e.g., 12-35%, 16-30%, etc.).

In some embodiments, the exothermic fibers (e.g., the hygroscopic exothermic fibers) are cut to a particular staple length. For example, in some embodiments, the exothermic fibers have a staple length of 8-85 mm (e.g., 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, or 85 mm), including any and all ranges and subranges therein (e.g., 12-85 mm, 20-40 mm, etc.). In some embodiments, including, for example, where the inventive insulation material is in the form of batting, the exothermic fibers have a staple length of 30-51 mm, including and all ranges and subranges therein.

The heat capturing fibers are fibers that are capable of retaining heat. The heat capturing fibers have a density of at least 1.17 g/cm$^3$ or 2.0 Dtex linear density. Such fibers differ from, e.g., feathers (which typically have a density of less than 1.0 g/cm$^3$), which have been used in prior art efforts as heat capturing fibers. Feathers, via their low density, accommodate sizeable air layers, which prior art has required to serve to retain heat in insulation. The present invention, on the other hand, does not require such an air layer.

In some embodiments, the heat capturing fibers have a density of at least 1.2 g/cm$^3$, or at least 1.3, 1.4, 1.5, 1.6, or 1.7 g/cm$^3$.

In some embodiments, the heat capturing fibers capable of retaining heat include less than 50 mL air per 1 gram of fiber (e.g., less than 45, or less than 40, or less than 35 mL air per 1 gram of fiber).

In some embodiments, the heat capturing fibers are selected from fibers containing ceramic, fibers containing carbon, and fibers containing phase change material (PCM).

PCMs are materials that store, release or absorb heat as they oscillate between solid and liquid form, giving off heat as they change to a solid state and absorbing it as they return to a liquid state. In some embodiments, PCMs change phases within a temperature range that is just above and just below human skin temperature. In some embodiments, the heat capturing fibers are fibers containing PCM in the form of microcapsules.

In some embodiments, the heat capturing fibers are polyester fibers that comprise ceramic particles. For example, in some embodiments the heat capturing fibers are polyester (e.g., PET) fibers that comprise, e.g., 0.5 to 25 wt % (e.g., 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 16, 17, 18, 19, 20, 21, 22, 23, 24, or 25 wt %) ceramic particles, including any and all ranges and subranges therein (e.g., 1-10 wt %). In some embodiments, the heat capturing fibers are TRIZAR fibers.

Any desired ratio of exothermic fibers to heat capturing fibers may be used. In some embodiments, the weight ratio of exothermic fibers to heat capturing fibers is 0.5:9.5 to 9.5:0.5, including any and all ranges and subranges therein. In some embodiments, the ratio is 4.5:5.5 to 9.5:0.5.

The synthetic fibers typically comprise fibers made from synthesized polymers or small molecules. Many synthetic fibers are known in the art, and any desired synthetic fibers may be used in the invention. Indeed, different fibers have different properties, and lend themselves toward advantageous uses in different applications. This information is well within the purview of persons having ordinary skill in the art. While a wide array of synthetic fibers may be used in the invention, in some embodiments, the synthetic fibers are selected from the group consisting of polyamide, polyester, acrylic, acrylate, acetate, polyolefin, nylon, rayon, lyocell, aramid, spandex, viscose, and modal fibers, and combinations thereof.

In particular embodiments, the synthetic fibers comprise polyester fibers. In some embodiments, such polyester fibers comprise one or more of poly(ethylene terephthalate), poly (hexahydro-p-xylylene terephthalate), poly(butylene terephthalate), poly-1,4-cyclohexelyne dimethylene (PCDT) and terephthalate copolyesters in which at least 85 mole percent of the ester units are ethylene terephthalate or hexahydro-p-xylylene terephthalate units. In a particular embodiment, the synthetic fibers are polyethylene terephthalate fibers.

In some embodiments, the synthetic fibers have a denier of 0.5 to 15 denier (e.g., 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, or 15.0 denier), including any and all ranges and subranges therein (e.g., 0.5 to 7 denier).

Denier is a unit of measure defined as the weight in grams of 9000 meters of a fiber or yarn. It is a common way to specify the weight (or size) of the fiber or yarn. For example, polyester fibers that are 1.0 denier typically have a diameter of approximately 10 micrometers. Micro-denier fibers are those having a denier of 1.0 or less, while macro-denier fibers have a denier greater than 1.0.

In some embodiments, the synthetic fibers are siliconized. The term "siliconized" means that the fiber is coated with a silicon-comprising composition (e.g., a silicone). Siliconization techniques are well known in the art, and are described, for example, in U.S. Pat. No. 3,454,422. The silicon-comprising composition may be applied using any method known in the art, e.g., spraying, mixing, dipping, padding, etc. The silicon-comprising (e.g., silicone) composition, which may include an organosiloxane or polysiloxane, bonds to an exterior portion of the fiber. In some embodiments, the silicone coating is a polysiloxane such as a methylhydrogenpolysiloxane, modified methylhydrogenpolysiloxane, polydimethylsiloxane, or amino modified dimethylpolysiloxane. As is known in the art, the silicon-comprising composition may be applied directly to the fiber, or may be diluted with a solvent as a solution or emulsion, e.g. an aqueous emulsion of a polysiloxane, prior to application. Following treatment, the coating may be dried and/or cured. As is known in the art, a catalyst may be used to accelerate the curing of the silicon-comprising composition (e.g., polysiloxane containing Si—H bonds) and, for convenience, may be added to a silicon-comprising composition emulsion, with the resultant combination being used to treat the synthetic fiber. Suitable catalysts include iron, cobalt, manganese, lead, zinc, and tin salts of carboxylic acids such as acetates, octanoates, naphthenates and oleates. In some embodiments, following siliconization, the fiber may be dried to remove residual solvent and then optionally heated to between 65° and 200° C. to cure.

In some embodiments, the synthetic fibers are slickened with another slickening agent, e.g., segmented copolymers of polyalkyleneoxide and other polymers, such as polyester, or polyethylene or polyalkylene polymers as is mentioned in U.S. Pat. No. 6,492,020 B1.

In some embodiments, the synthetic fibers have a length of 12-85 mm (e.g., 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, or 85 mm), including any and all ranges and subranges therein (e.g., 20-60 mm).

Figure 3:
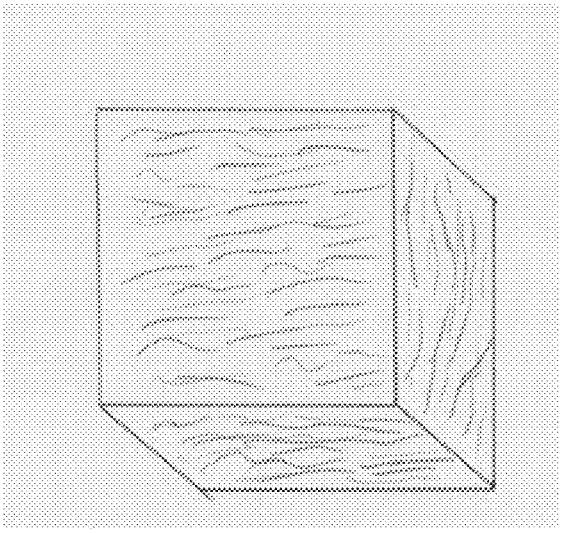
FIG. 3 depicts a simplified cross section of insulation material according to an embodiment of the invention.

In some embodiments of the inventive insulation material, the exothermic fibers, heat capturing fibers, and polyester fibers are present in a homogeneous mixture. As used herein, a homogeneous mixture is one having a 90-100% uniform composition. Such an embodiment is depicted in FIG. 3, which shows a simplified cross section of an embodiment of insulation material.

In some embodiments, the inventive insulation material additionally comprises binder fibers. Binder fibers are well known in the art, and an array of binder fibers are commercially available. The binder fibers used in the present invention may be conventional binder fibers (e.g., low-melt polyester binder fibers), or other binder fibers, provided that whatever binder fiber is used, the binder fiber has a bonding temperature lower than the softening temperature of the synthetic fibers. Binder fibers are discussed, for example, in U.S. Pat. No. 4,794,038, and general protocols for certain embodiments of binder fibers are set forth in U.S. Pat. No. 4,281,042 and in U.S. Pat. No. 4,304,817. In some embodiments, the binder fibers are monocomponent fibers. In some components, the binder fibers are multicomponent fibers (e.g., bicomponent fibers, for example, sheath-core fibers, where the core comprises a higher melting component than the sheath). In some embodiments, the binder fibers comprise blends of one or more different types of binder fibers.

As indicated above, the binder fibers have a bonding temperature lower than the softening temperature of the synthetic fibers. In some embodiments, the binder fibers have a bonding temperature of less than or equal to 200° C. In some embodiments, the binder fibers have a bonding temperature of 50 to 200° C. (e.g., 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, or 200° C.), including any and all ranges and subranges therein. In some embodiments, the binder fibers have a bonding temperature of 80° C. to 150° C. In some embodiments, the binder fibers have a bonding temperature of 100° C. to 125° C.

In some embodiments, the binder fibers have a melting temperature that is 15 to 60° C. less than the melting temperature of the synthetic fibers. For example, in some embodiments, the binder fibers have a melting temperature that is 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60° C. less than the melting temperature of the synthetic fibers.

In some embodiments, the binder fibers comprise low-melt polyester fibers.

In some embodiments, the binder fibers are bicomponent fibers comprising a sheath and a core, wherein the sheath comprises a material having a lower melting point than the core.

The inventive insulation material, in some embodiments, has been heat treated so as melt all or a portion of the binder fibers, thereby forming, e.g., a bonded web-type batting. Persons having ordinary skill in the art will understand that, in such embodiments, although "binder fibers" are recited as being comprised within the insulation material, said fibers may be wholly or partially melted fibers, as opposed to binder fibers in their original, pre-heat treatment form.

In some embodiments, binder fibers have a denier of 1.0 to 5.0 (e.g., 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0 denier), including any ranges/subranges therein (e.g., 1.5 to 3.5 mm, 1.9 to 2.5 mm, etc.).

In some embodiments, the binder fibers have a length of 20 mm to 71 mm (e.g., 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, or 71 mm), including all ranges/subranges therein (e.g., 20 to 60 mm).

The various fibers discussed herein (exothermic fibers, heat capturing fibers, synthetic fibers, binder fibers, etc.), may be crimped or uncrimped. Various crimps, including spiral and standard crimp, are known in the art. The fibers may typically have any crimp.

In some embodiments, the exothermic fibers, heat capturing fibers, and synthetic fibers all individually have deniers of 0.7 to 7.0 (e.g., 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, or 7.0 denier), including any and all ranges and subranges therein.

In some embodiments, the exothermic fibers, heat capturing fibers, and synthetic fibers all individually have cut lengths of 13 mm to 64 mm (e.g., 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, or 64 mm), including any and all ranges and subranges therein.

In some embodiments, the inventive insulation material comprises 5 to 50 wt % exothermic fibers (e.g., 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 wt %), including any and all ranges and subranges therein (e.g., 10-30 wt %).

In some embodiments, the inventive insulation material comprises 20 to 80 wt % heat capturing fibers (e.g., 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, or 80 wt %), including any and all ranges and subranges therein (e.g., 40-60 wt %).

In some embodiments, the inventive insulation material comprises 2 to 50 wt % of the synthetic fibers (e.g., 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 wt %), including any and all ranges and subranges therein (e.g., 10-20 wt %).

In some embodiments, the inventive insulation material comprises 5 to 40 wt % of binder fibers (e.g., 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40 wt %), including any and all ranges and subranges therein (e.g., 10-30 wt %).

Figure 4:
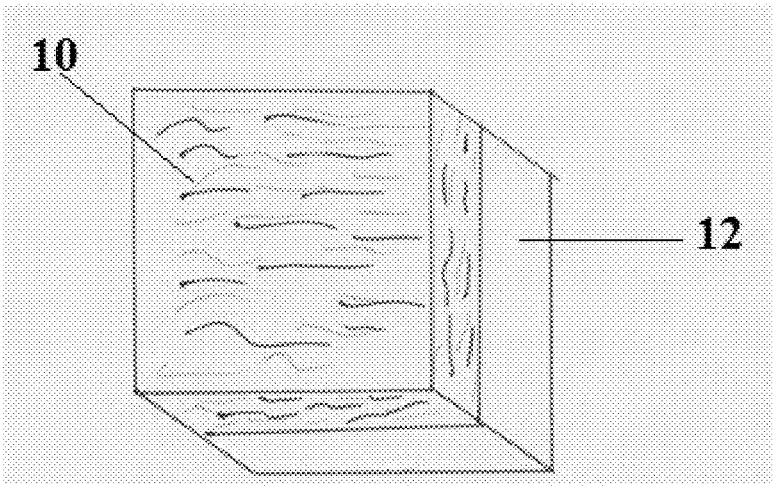
FIG. 4 depicts a simplified cross section of insulation material according to another embodiment of the invention.

As shown in FIG. 4, in some embodiments, the inventive insulation material comprises a first layer 10 and a second layer 12, wherein the first layer comprises the exothermic fibers and the heat capturing fibers, and the second layer comprises the synthetic fibers. In such embodiments, the second layer 12 can assist in providing loft to the insulation material. In some embodiments, the first layer 10 is configured to face a wearer or user's skin when the insulation material is comprised within an article.

Figure 5:
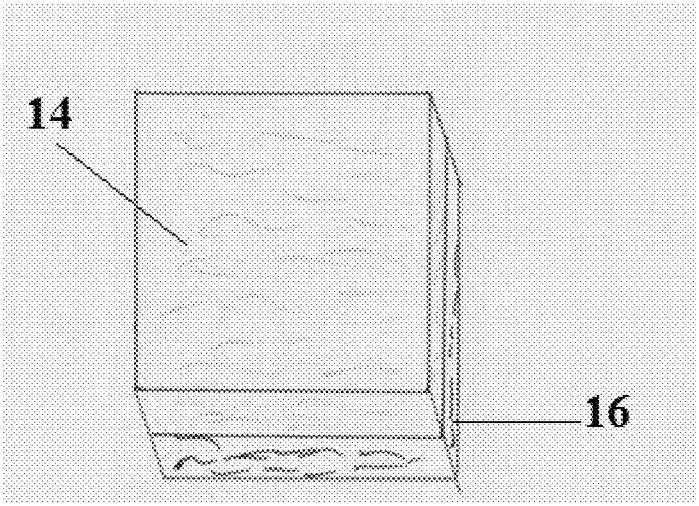
FIG. 5 depicts a simplified cross section of insulation material according to another embodiment of the invention.

As shown in FIG. 5, in some embodiments, the inventive insulation material comprises a first layer 14 and a second layer 16, wherein the first layer 14 comprises the exothermic fibers and the synthetic fibers, and the second layer 16 comprises the heat capturing fibers. In some embodiments, the first layer 14 is configured to face a wearer or user's skin when the insulation material is comprised within an article.

Figure 6:
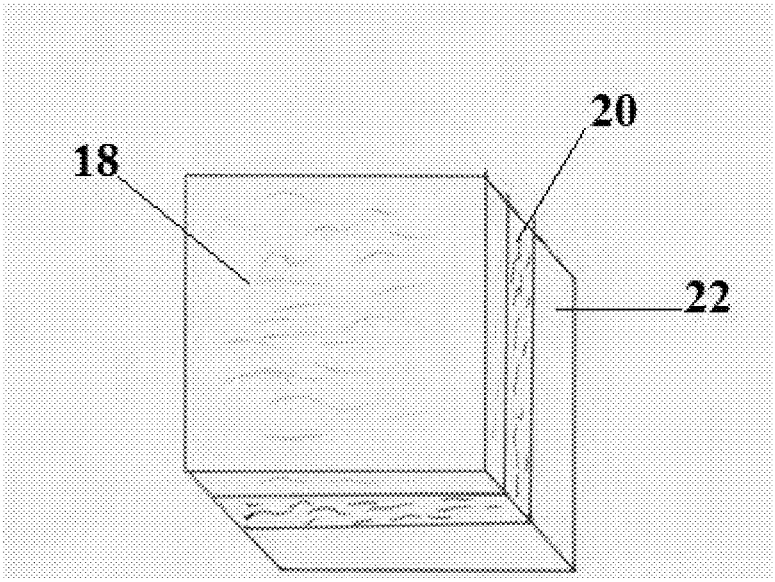
FIG. 6 depicts a simplified cross section of insulation material according to another embodiment of the invention.

As shown in FIG. 6, in some embodiments, the inventive insulation material comprises a first layer 18, a second layer 20, and a third layer 22, wherein the first layer 18 comprises the exothermic fibers, the second layer 20 comprises the heat capturing fibers, and the third layer 22 comprises the synthetic fibers. In some embodiments, the first layer 18 is configured to face a wearer or user's skin when the insulation material is comprised within an article.

The inventive insulation material may be provided in any desired form. For example, in some embodiments, the insulation material is in the form of batting. In some embodiments, the batting has a thickness of less than or equal to 40 mm, e.g., 5 to 40 mm (e.g., 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40 mm), including all ranges and subranges therein. In some embodiments, the batting has a density of 2 to 12 $kg/m^3$ (e.g., 2, 3, 4, 5, 6, 7, 8, 9, 10, 11, or 12 $kg/m^3$), including any and all ranges and subranges therein.

In some embodiments, the insulation material is in the form of blowable clusters. In other embodiments, the insulation material is in the form of yarn.

In a second aspect, the invention provides an article comprising the insulation material of the first aspect of the invention. Non-limiting examples of such articles include, for example, outerwear (e.g. outerwear garments such as jackets, etc.), clothing, sleeping bags, bedding (e.g., comforters), household goods, etc.

In a third aspect, the invention provides a method of forming the inventive insulation material. The method comprises incorporating the materials of the first aspect of the invention into the desired form of insulation (e.g., batting, blowable clusters, yarn, etc.).

EXAMPLES

The invention will now be illustrated, but not limited, by reference to the specific embodiments described in the following examples.

Self-Warming Insulation Material and Comparative Insulation Material.

Insulation Material A.

Insulation material was made using acrylate-based hygroscopic and exothermic fibers. Specifically, SUNBURNER fibers available from Toho Textiles were used. A fiber mix was prepared by homogeneously mixing 15 wt % 2.3 T×38 mm SUNBURNER fibers with 50 wt % heat capturing fibers (1.2 denier×38 mm polyester fibers with 2 wt % ceramic particulates dispersed throughout), 15 wt % 1.4 denier×51 mm synthetic fibers (100% siliconized polyester fibers), and 20 wt % 2.2 denier×38 mm binder (low melt bi-component polyester binder fiber).

The fiber mix is processed through a carding machine to obtain a non-woven web batting pre-cursor. A second layer of 100% polyester batting is used in order to increase the overall do, and loft to higher levels without increasing the overall weight of resultant batting too much. The precursor is heated at 110° C. to form an embodiment of the inventive insulation material. The resultant embodiment provides a self-warming insulation in the form of batting.

Insulation Material B.

Insulation material was made using acrylate-based hygroscopic and exothermic fibers. Specifically, EKS fibers available from Toyobo Co., Ltd. were used. A fiber mix was prepared by homogeneously mixing 15 wt % 2.3 T×38 mm EKS fibers with 50 wt % heat capturing fibers (1.2 denier×38 mm polyester fibers with 2 wt % ceramic particulates dispersed throughout), 15 wt % 1.4 denier×51 mm synthetic fibers (100% siliconized polyester fibers), and 20 wt % 2.2 denier×38 mm binder (low melt bi-component polyester binder fiber).

The fiber mix is processed through a carding machine to obtain a non-woven web batting pre-cursor. A second layer of 100% polyester batting is used in order to increase the overall do, and loft to higher levels without increasing the overall weight of resultant batting too much. The precursor is heated at 110° C. to form an embodiment of the inventive insulation material. The resultant embodiment provides a self-warming insulation in the form of batting.

Comparative Insulation Material C.

Insulation material (not according to the invention) was made using 100% polyester and binder fibers. A fiber mix was prepared by homogeneously mixing 80 wt % synthetic polyester fibers, and 20 wt % 2.2 denier×38 mm binder (low melt bi-component polyester binder fiber).

The fiber mix is processed through a carding machine to obtain a non-woven web batting pre-cursor. A second layer of 100% polyester batting is also used. The precursor is heated at 110° C. to form a comparative example of insulation material in the form of batting.

Hygroscopic Heat Generation Testing.

Hygroscopic Heat Generation Testing was performed on Insulation Materials A, B, and C in accordance with BOKEN Standard BQE A 035. The insulation materials (20 cm×20 cm samples) are placed in a chamber set to 80° C. for four hours, then are placed in a desiccator overnight with silica gel. The test samples are folded in half with a thermo couple on their center surface, and are then folded in half again. The samples are placed into a chamber at 20° C., 40% relative humidity (RH) for two hours, then conditions are changed to 20° C., 90% RH, with temperature data gathered every minute over the course of 15 minutes. The temperature data results are summarized in Table I.

TABLE I

| Time | Temperature (° C.) | | | Chamber |
|---|---|---|---|---|
| (minute) | A | B | C | RH (%) |
| 0 | 20.7 | 20.8 | 20.5 | 40.0 |
| 1 | 22.8 | 22.7 | 20.6 | 72.2 |
| 2 | 25.8 | 23.0 | 20.7 | 73.7 |
| 3 | 25.7 | 23.2 | 20.8 | 74.8 |
| 4 | 25.1 | 23.3 | 20.9 | 76.2 |

TABLE I-continued

| Time | Temperature (° C.) | | | Chamber |
|---|---|---|---|---|
| (minute) | A | B | C | RH (%) |
| 5 | 24.9 | 23.5 | 21.0 | 76.7 |
| 6 | 24.4 | 23.7 | 21.1 | 78.0 |
| 7 | 24.1 | 23.9 | 21.2 | 79.4 |
| 8 | 23.9 | 24.1 | 21.0 | 80.1 |
| 9 | 23.8 | 24.2 | 20.9 | 80.9 |
| 10 | 23.6 | 24.3 | 20.9 | 81.9 |
| 11 | 23.5 | 24.2 | 20.8 | 82.7 |
| 12 | 23.3 | 24.2 | 20.8 | 83.6 |
| 13 | 23.2 | 24.1 | 20.8 | 83.8 |
| 14 | 23.1 | 24.0 | 20.8 | 84.2 |
| 15 | 23.0 | 23.9 | 20.8 | 85.3 |

Figure 7:
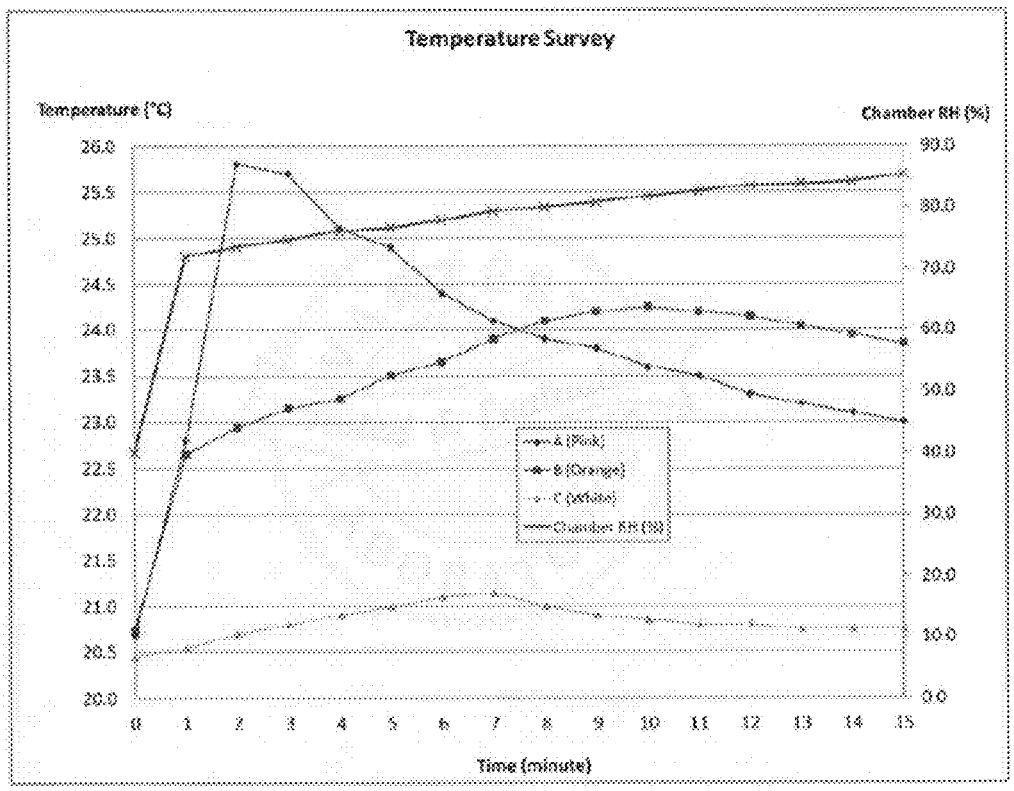
FIG. 7 is a chart depicting heat generation testing results of embodiments of insulation material according to the invention, and of a comparative insulation material.

FIG. 7 is a chart depicting the heat generation testing results.

As is evidenced from the foregoing data and FIG. 7, embodiments A and B according to the invention generated significantly more heat than comparative polyester batting C, thus evidencing their advantageous self-warming properties.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

The invention claimed is:

1. An insulation material comprising:

exothermic fibers;

heat capturing fibers capable of retaining heat, said heat capturing fibers having a density of at least 1.17 g/cm$^3$ or 2.0 Dtex linear density; and synthetic fibers.

2. The insulation material according to claim 1, wherein the exothermic fibers are hygroscopic exothermic fibers.

3. The insulation material according to claim 2, comprising a first layer, a second layer, and a third layer, wherein the first layer comprises the exothermic fibers, the second layer comprises the heat capturing fibers, and the third layer comprises the synthetic fibers.

4. The insulation material according to claim 2, wherein the hygroscopic exothermic fibers have a moisture absorption rate of at least 12%.

5. The insulation material according to claim 4, comprising a first layer, a second layer, and a third layer, wherein the first layer comprises the exothermic fibers, the second layer comprises the heat capturing fibers, and the third layer comprises the synthetic fibers.

6. The insulation material according to claim 2, wherein the hygroscopic exothermic fibers are selected from the group consisting of sheep wool, acrylate-based hygroscopic and exothermic fibers, and fibers containing activated carbon.

7. The insulation material according to claim 1, wherein the exothermic fibers are selected from the group consisting of sheep wool, acrylate-based hygroscopic and exothermic fibers, fibers containing activated carbon, and heat-generative acrylic fibers.

8. The insulation material according to claim 7, comprising a first layer, a second layer, and a third layer, wherein the first layer comprises the exothermic fibers, the second layer comprises the heat capturing fibers, and the third layer comprises the synthetic fibers.

9. The insulation material according to claim 1, wherein the heat capturing fibers are selected from fibers containing ceramic, fibers containing carbon, and fibers containing phase change material.

10. The insulation material according to claim 1, wherein the exothermic fibers, heat capturing fibers, and synthetic fibers are present in a homogenous mixture.

11. The insulation material according to claim 1, comprising a first layer and a second layer, wherein the first layer comprises the exothermic fibers and the heat capturing fibers, and the second layer comprises the synthetic fibers.

12. The insulation material according to claim 1, comprising a first layer and a second layer, wherein the first layer comprises the exothermic fibers and the synthetic fibers, and the second layer comprises the heat capturing fibers.

13. The insulation material according to claim 1, comprising a first layer, a second layer, and a third layer, wherein the first layer comprises the exothermic fibers, the second layer comprises the heat capturing fibers, and the third layer comprises the synthetic fibers.

14. The insulation material according to claim 1, wherein the insulation material is in the form of batting.

15. The insulation material according to claim 1, wherein the insulation material is in the form of blowable clusters.

16. The insulation material according to claim 1, wherein the insulation material is in the form of yarn.

17. The insulation material according to claim 1, wherein the synthetic fibers are polyester fibers.

18. The insulation material according to claim 1, wherein the heat capturing fibers capable of retaining heat include less than 50 mL air per 1 gram of fiber.

19. An article comprising the insulation material according to claim 1.

20. The article according to claim 19, wherein the article is selected from footwear, clothing, bedding, and a sleeping bag.

* * * * *